US006056539A

United States Patent [19]

Carlson

[11] Patent Number: 6,056,539

[45] Date of Patent: May 2, 2000

[54] COMBINED LIGHTER AND MOUTH SPRAY

[76] Inventor: Stephen Carlson, 9823 Quincy St. NE., Blaine, Minn. 55434

[21] Appl. No.: 09/372,851

[22] Filed: Aug. 12, 1999

Related U.S. Application Data

[60] Provisional application No. 60/096,229, Aug. 12, 1998.

[51] Int. Cl.[7] ..... F23Q 3/00

[52] U.S. Cl. ..... 431/253

[58] Field of Search ..... 431/253

[56] References Cited

U.S. PATENT DOCUMENTS

| | | | |
|---|---|---|---|
| 2,434,825 | 1/1948 | Williams | 21/116 |
| 2,521,630 | 9/1950 | Florman | 21/61 |
| 4,515,556 | 5/1985 | Vanelli | 431/253 |
| 4,583,939 | 4/1986 | Brickwedde | 431/253 |

*Primary Examiner*—Carroll Dority

*Attorney, Agent, or Firm*—Larkin, Hoffman, Daly & Lindgren, Ltd.

[57] ABSTRACT

A combined lighter device and breath spray device wherein the lighter device is secured to the breath spray device through a hinge structure. The lighter device further defines a cavity defined thereon for receiving a portion of the breath spray device when in an undeployed orientation. Additionally, a cover structure is provided to prevent discharge of the lighter device when not in use.

10 Claims, 3 Drawing Sheets

COMBINED LIGHTER AND MOUTH SPRAY

This application claims benefit of Provisional Application Ser. No. 60/096,229 filed Aug. 12, 1998.

FIELD OF THE INVENTION

The present invention relates to a combined lighter device and breath spray device, and more particularly to a hand-held article housing a cigarette lighter and a breath spray device and having protective covers to minimize accidental discharge of either device.

BACKGROUND OF THE INVENTION

A combined incense vaporizer and cigar lighter is disclosed in U.S. Pat. No. 2,434,825 to Williams, et al. The Williams '825 device relates to an incense vaporizer adapted for use as a cigar lighter and has for its object to provide a device embodying means for generating a flame which flame may be used as a cigar lighter, in combination with means for projecting a pan over the flame and causing incense liquid to come onto the pan and be vaporized by the flame.

A combined perfumed dispenser and cigarette lighter is disclosed in U.S. Pat. No. 4,583,939 to Brickwedde. The Brickwedde '939 device provides a cigarette lighting mechanism and a perfume dispensing mechanism within an integrated housing.

A combined perfumed dispenser and cigar lighter is disclosed in U.S. Pat. No. 2,521,630 to Florman. The Florman '630 device provides a cigarette lighting mechanism and a perfume dispensing mechanism, the latter including a movable nozzle or outlet orifice to discharge perfume either on the cigarette lighting mechanism or on any other points to mask unpleasant odors.

A combined lighter and spray device is disclosed in U.S. Pat. No. 4,515,556 to Vanelli. The Vanelli '556 patent discloses an elongated case which defines a pair of side-by-side chambers which extend along substantially the entire length of the case, a lighter disposed in one of the chambers and having an operating mechanism which extends from one end of the case, and a breath spray device disposed in the other chamber and having an operating end which extends from the other end of the case. The operating mechanisms of the lighter and breath spray device are on opposed ends of the integrated housing or case, which necessitates the device's inversion during use. Purportedly, neither operating mechanism is protected by an external cover or cap when not in use. Such cap or cover would limit the potential for unintentional discharge of the associated device.

SUMMARY OF THE INVENTION

Addressing the deficiencies of the conventional art, the instant invention resolves the problems in an efficient, and cost effective manner.

One aspect of the present invention provides a multi-part case for a lighter device and a mouth spray device, wherein the two devices are pivotally joined relative to each other.

Another aspect of the present invention provides a separate protective cover for both the lighter device and the mouth spray device which minimize a potential for unintentional use or discharge of either device.

Yet another aspect of the present invention is a nesting-feature, wherein at least a portion of the breath spray device is received into a cavity defined by the lighter device.

Additionally, user access to both the lighter device and the mouth spray device may be made without an inversion of the device.

The above and other objects, features, and advantages of the present invention are further disclosed in the following detailed description in conjunction with the drawings.

DESCRIPTION OF PREFERRED EMBODIMENTS

Figure 1:
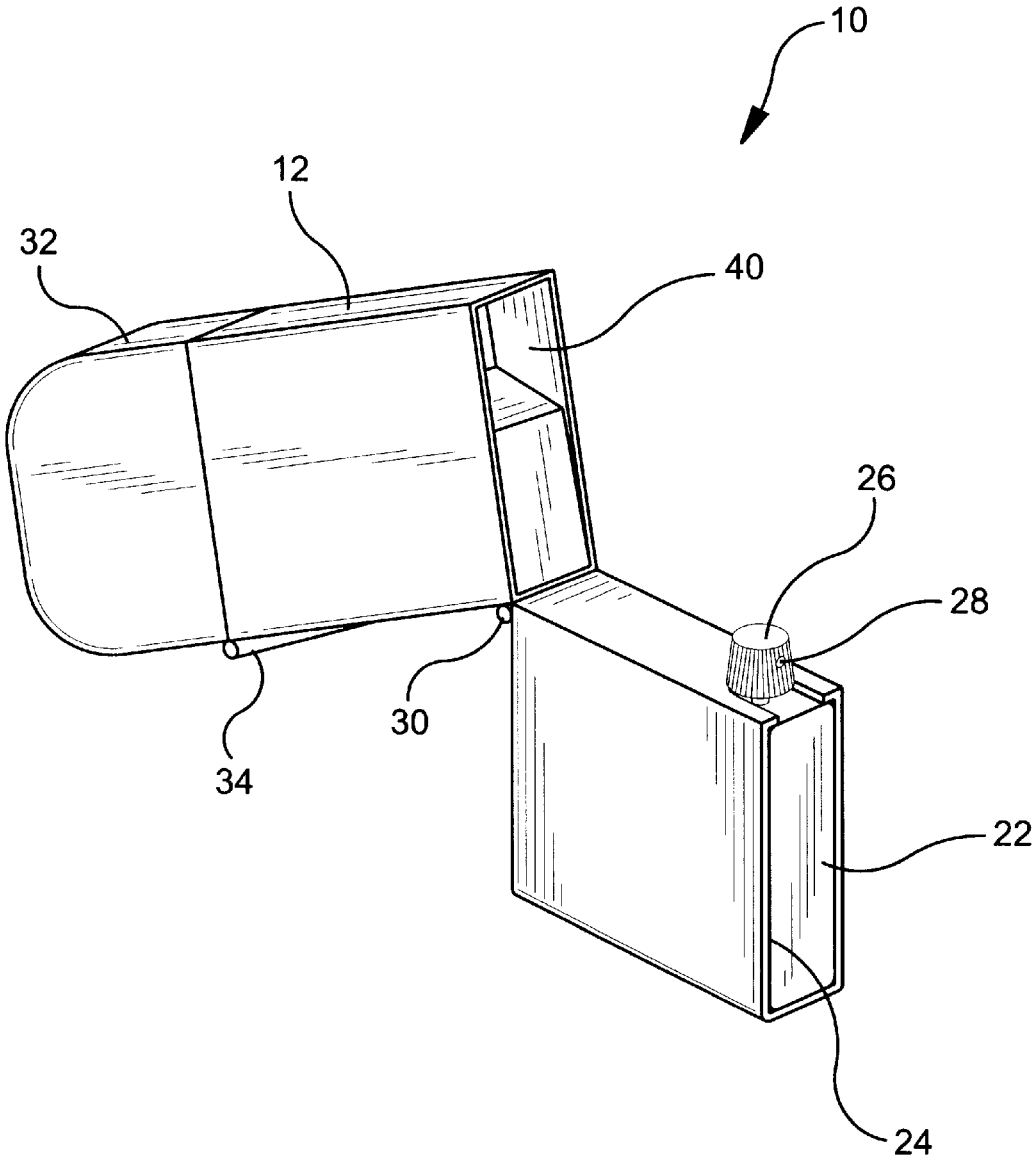
FIG. 1 is a perspective view of the combined cigarette lighter and breath spray dispenser according to the present invention.

Referring now to the drawings, where like numerals represent like parts throughout, FIGS. 1 through 4 illustrate a combined cigarette lighter and breath spray dispenser device 10. The cigarette lighter 12 includes a lighting mechanism 14 for igniting an open flame 16, a fuel conveyance apparatus 18, and a fuel reservoir 20. The fuel reservoir 20 may be a refillable butane reservoir. The breath spray dispenser 22 includes a reservoir 24 adapted to hold a supply of breath spray and a dispensing mechanism 26 for dispensing the breath spray from the reservoir 24. The dispensing mechanism 26 includes a discharge orifice 28 to discharge the breath spray therefrom. The dispensing mechanism 26 may be a simple fluid pump or may be selected from among the variety of known fluid dispensing devices, e.g., gas pressurized reservoir with dispensing valve, etc. A portion of the dispensing mechanism 26 may be rotatable to direct the emitted spray in a predetermined direction.

Figure 2:
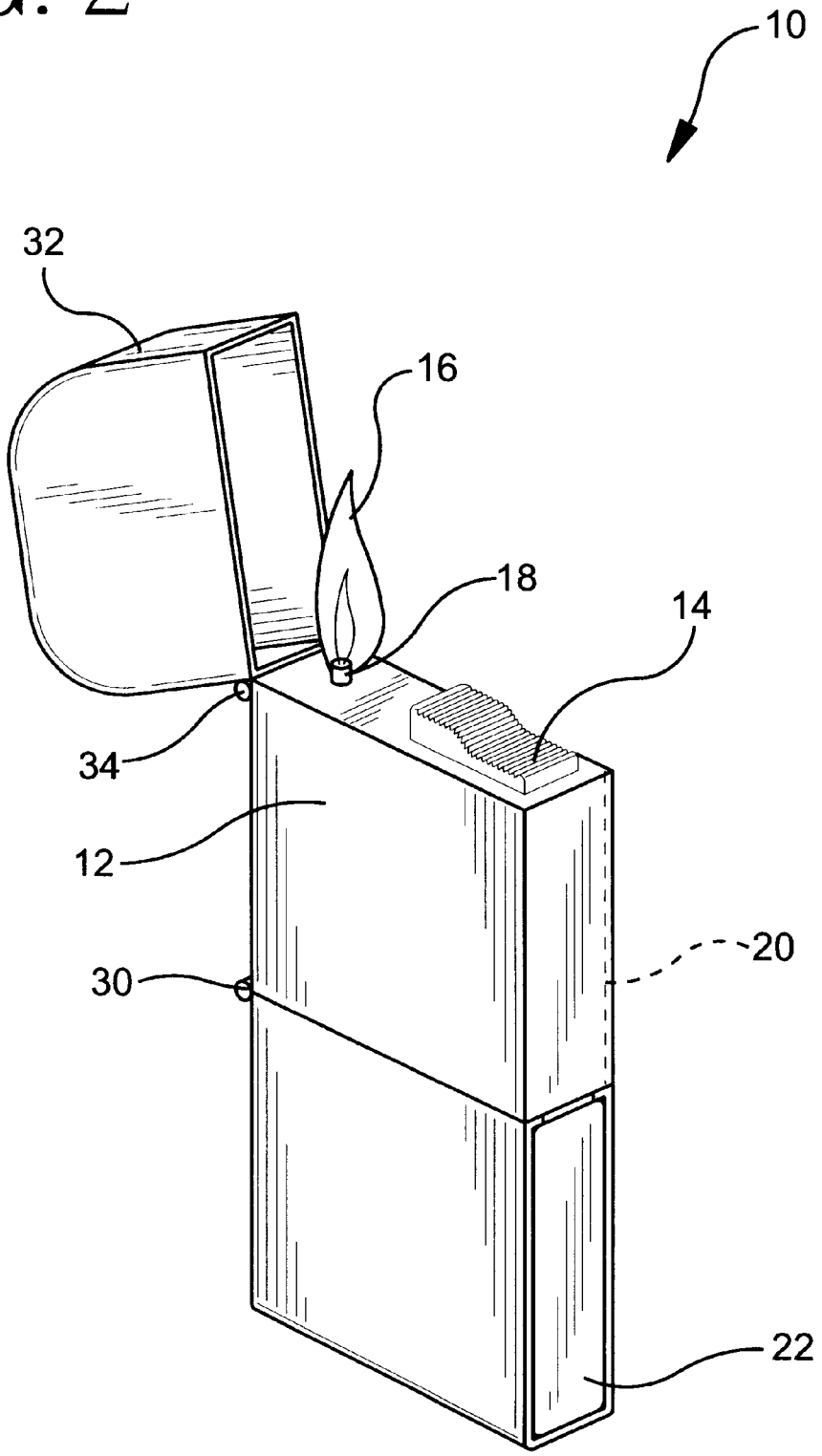
FIG. 2 is another perspective view of the device of FIG. 1.

As illustrated in FIGS. 1 and 2, the cigarette lighter 12 and breath spray device 22 are pivotally secured relative to each other by a linear hinge 30. Access for use of the breath spray device 22 (as illustrated in FIG. 1) is made by pivoting the breath spray device relative 22 to the cigarette lighter 12 about the hinge 30. After a use of the breath spray device 22, the user may enclose the breath spray device 22 by pivotally manipulating the lighter 12 and breath spray device 22 to an updeployed orientation (as illustrated in FIG. 2). A portion of the breath spray device 22 is received into a bottom cavity 40 of the cigarette lighter 12.

As further illustrated in FIG. 2, access to the cigarette lighter 12 may be made by pivotally manipulating a lighter cover 32 structure about a cover hinge 34. The cigarette lighter 12 may be a Zippo® style lighter or may be selected from among a variety of known cigarette lighter 12 devices. At least a portion of the cigarette lighter 12 is received into an inner cavity defined by the cover 32.

Figure 3:
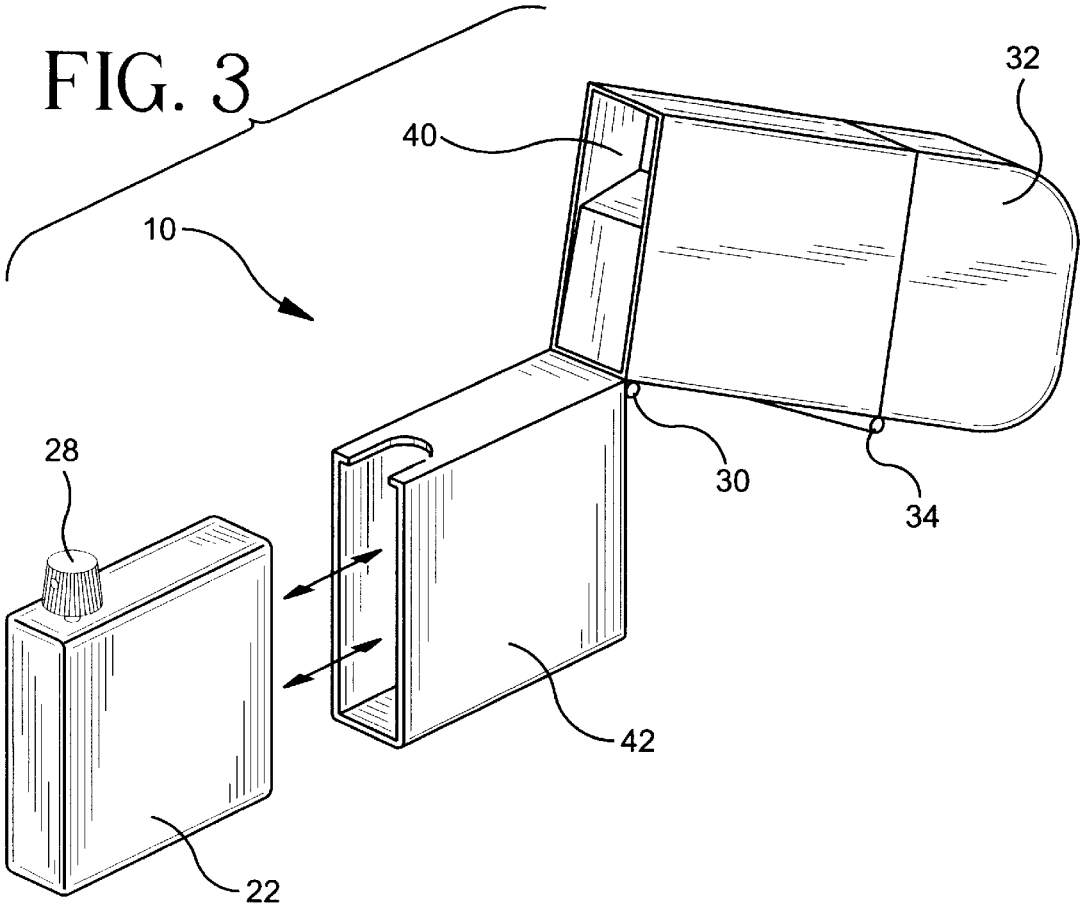
FIG. 3 is another perspective view of the device of FIG. 1.

Referring now to FIG. 3, the combined cigarette lighter 12 and breath spray device 22 are illustrated in an undeployed orientation. The cigarette lighter 12 is protected from accidental discharge by its cover 32, while the breath spray mechanism 22 is protected from accidental discharge by being received into the bottom cavity 40 of the cigarette lighter 12. The hinges 30, 32 are illustrated in this embodiment as being aligned on the same side 36 of the device 10. Alternatively, the hinges 30, 32 for the cigarette lighter 10 and breath spray device 22 may be on opposite sides.

Figure 4:
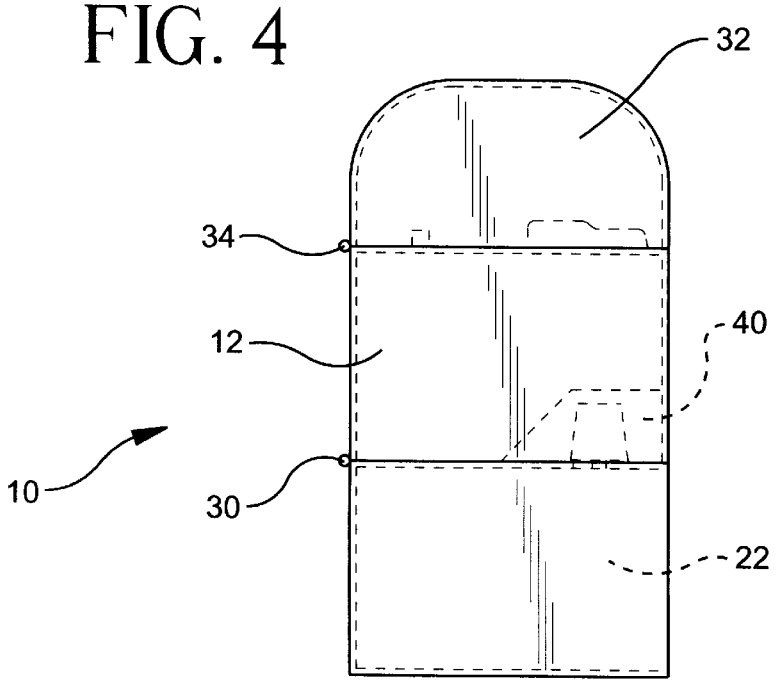
FIG. 4 is a side elevational view of the device of FIG. 1.

With reference to FIG. 4, a particular feature of the device 10 is illustrated. The breath spray device 22 may be a discrete member and separable from the device 10, e.g., during refilling or replacement. The breath spray member 22 may be received into a breath spray shell member 42 during intended use.

The above described embodiments of the invention are merely descriptive of its principles and are not to be considered limiting. Further modifications of the invention herein disclosed will occur to those skilled in the respective arts and all such modifications are deemed to be within the scope of the invention as defined by the following claims.

I claim:

1. An apparatus comprising:

a cigarette lighter device having a housing member and a lighting mechanism, said housing member having a bottom cavity portion; and a breath spray device for discharging a spray from a breath spray reservoir, said breath spray device having a discharge mechanism for controlling a discharge of the breath spray from the device, said device being hingedly secured to the housing member, the apparatus having an undeployed orientation wherein at least a portion of the discharge mechanism is received into the bottom cavity portion of the cigarette lighter device.

2. The apparatus of claim 1 further comprising:

a cover for the cigarette lighter device, said cover being hingedly secured to the cigarette lighter device and having an inner cavity for receiving at least a portion of the lighting mechanism.

3. The apparatus of claim 2 wherein the hinge securing the breath spray device to the housing member and the hinge securing the cover to the cigarette lighter device are aligned on a side of the apparatus.

4. The apparatus of claim 1 wherein the breath spray reservoir is adapted to be removably secured to the breath spray device.

5. The apparatus of claim 1 further having a deployed orientation wherein the at least a portion of the discharge mechanism is revealed to the user.

6. A combined lighter and breath spray which comprises:

a case defining upper and lower portions, said upper and lower portions being secured relative to each other through a hinge structure, said upper portion having a cavity;

a lighter unit secured to the case at the upper portion, said lighter having an operating end for generating a flame; and a breath spray unit having an operating end for discharging a breath spray, said breath spray unit secured to the case at the lower portion, and at least a portion of the operating end being received into the cavity of the upper portion of the case.

7. The combined lighter and breath spray device of claim 6 further comprising:

a cover hingedly secured to the upper portion of the case for covering at least a portion of the operating end of the lighter unit.

8. The combined lighter and breath spray device of claim 6 wherein the hinge securing the breath spray device to the case and the hinge securing the cover to the case are aligned on a side of the apparatus.

9. The apparatus of claim 6 wherein the breath spray unit has a reservoir which is adapted to be removably secured to the breath spray unit.

10. The apparatus of claim 6 wherein the lighter unit includes a refillable butane reservoir.

* * * * *